US005418323A

United States Patent [19]

Kohonen

[11] Patent Number: 5,418,323

[45] Date of Patent: May 23, 1995

[54] METHOD FOR CONTROLLING AN ELECTRONIC MUSICAL DEVICE BY UTILIZING SEARCH ARGUMENTS AND RULES TO GENERATE DIGITAL CODE SEQUENCES

[76] Inventor: Teuvo Kohonen, Mellstenintie 9 C. 2, SF-02170, Espoo, Finland

[21] Appl. No.: 42,009

[22] Filed: Apr. 2, 1993

Related U.S. Application Data

[63] Continuation-in-part of Ser. No. 777,398, Dec. 3, 1991, abandoned.

[30] Foreign Application Priority Data

Jun. 6, 1989 [FI] Finland ..... 892764

[51] Int. Cl.[6] ..... G10H 7/00

[52] U.S. Cl. ..... 84/609

[58] Field of Search ..... 84/600, 601, 609, 610, 84/613, 634, 637, 645

[56] References Cited

U.S. PATENT DOCUMENTS 5,138,928 8/1992 Nakajima et al. ..... 84/635

5,202,526 4/1993 Ohya ..... 84/637 X

*Primary Examiner*—William M. Shoop, Jr.

*Assistant Examiner*—Jeffrey W. Donels

*Attorney, Agent, or Firm*—Dennison, Meserole, Pollack & Scheiner

[57] ABSTRACT

The invention relates to a method of producing a digital code sequence, particularly a note code sequence from a finite number of different code types, each representing one or more quantized properties of, for instance, a predetermined note, wherein new codes are generated one at a time after the code sequence on the basis of the existing codes of the sequence. The present invention utilizes rule propositions produced on the basis of mutual local equivalences between symbols occurring in an example material. A new code is attempted to be produced first on the basis of the code produced last and then more and more new codes are tested to find on the basis of them a rule proposition which unambiguously gives the code sequence of the new code.

6 Claims, 4 Drawing Sheets

FIG. 1
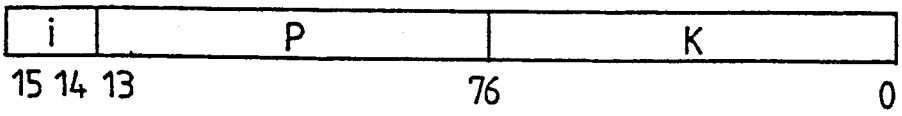
| MP | X | Y | Z |
|---|---|---|---|
| ⋮ | ⋮ | | |
| 10 | F | G | 1 |
| 11 | KF | H | 0 |
| 12 | EF | J | 1 |
| 13 | DEF | G | 0 |
| 14 | LEF | J | 0 |
| ⋮ | ⋮ | | |
FIG. 2
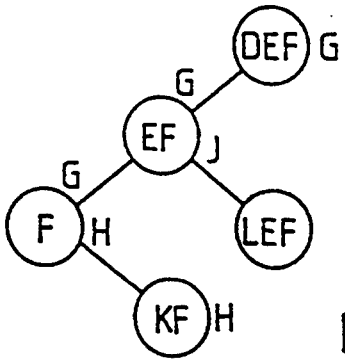
FIG. 3

METHOD FOR CONTROLLING AN ELECTRONIC MUSICAL DEVICE BY UTILIZING SEARCH ARGUMENTS AND RULES TO GENERATE DIGITAL CODE SEQUENCES

This application is a continuation-in-part of Ser. No. 07/777,398 filed Dec. 3, 1991, now abandoned.

FIELD OF THE INVENTION

The invention relates generally to a computer-based method of controlling musical electronic instruments by a control code sequence automatically composed music by a computer, each code in the composed code sequence representing one or more quantized properties of a predetermined note.

BACKGROUND OF THE INVENTION

Musical productions that sound agreeable but lack the form of an independent work of art are often used as background music in films, plays and other presentations. The quantitative need of this kind of music may be considerable. Quiet music is also used extensively in shops and other public premises to entertain customers and to create a desired atmosphere. One way of producing such background music is to use an electric device generating so-called synthesized music. Such devices comprise one or more electronic musical instruments or synthesizers and an automatic device producing control signals for them.

One way of producing such control code sequences and signals is to use so-called artificial intelligence programs utilizing heuristically rules based on musical expertise. The present invention, however, is not concerned with this kind of expert methods but with a device forming the required rules automatically on the basis of example material and producing new code sequences automatically with the aid of these rules. One such approach is disclosed in U.S. Pat. No. 4,926,737 to Minamitaka.

One prior art device producing control signals is based on Markov processes, in which each note (pitch, duration) is treated as a single stochastic state in a sequence of states. If example material, that is, note material, is given, the probability Pr of a state $S_i$ in the sequence is $Pr(S_i|S_{i-1}, S_{i-2}, \ldots)$ when the preceding states in the sequence are $S_{i-1}$, $S_{i-2}$, etc. Three preceding states are often sufficient to achieve a satisfactory outcome in music based on Markov processes. New music is generated by probability functions stored in the memory, starting from a key sequence to which is added a successor state having the highest probability on the basis of the probability function Pr and, e.g. the last three notes or states in the sequence. The sequence so increased is used as a new key sequence so that the process generates endlessly note code material and control signals for electronic musical instruments or synthesizers. Moreover, additional operations or rules are needed to produce typical musical structures from melody parts.

This prior art method of generating note codes requires large amounts of training material to form conditional probability density functions. In addition, synthesized music produced as described above does not usually comprise any surprise element and is monotonous, since each note has the same value in a stochastic process, whereas the same is not true with the properties of natural music.

SUMMARY OF THE INVENTION

The object of the present invention is to provide for control of electronic musical instruments an automatic control signal generation method which increases melodic variation and avoids or alleviates certain problems associated with the prior art.

This is achieved by means of a method of controlling an electronic musical device, comprising the steps of:

providing a search table containing rules for the generation of sequences of control codes, each rule consisting of a search-argument part of variable but limited length, a possible consequence to the search argument, and additional information about possible conflicts of this rule with other rules;

ranking the rules on successively higher levels according to the length of their search-argument part;

logically forming a tree structure;

accessing the table on the basis of the search-argument part;

generating a digital code sequence, each code in this sequence representing a musical element such as a predetermined note, fraction of a note, or group of notes, whereby new codes are generated one at a time on the basis of the last codes in the earlier generated sequence and information searched from the table, and appended to the earlier generated sequence, the generation of each new code including at least the steps of forming a tentative ordered set of search arguments to be used in a sequential search;

ranking said search arguments on successively higher levels according to the number of codes used in them, with a lowest-level search argument consisting of the last code and higher-level search arguments being formed of two or more last codes taken from the earlier generated code sequence;

starting with the lowest-level search argument, performing a sequential search in the table and continuing with gradually higher-level search arguments and until a conflict-free rule of the higher predetermined level is reached, or the sequential search that started as successful finally is terminated as unsuccessful;

randomly selecting the consequential code to be appended to the earlier generated code sequence from a specified subset of rules encountered in said sequential search;

converting said generated code sequence into a digital control signal; and automatically controlling the electronic musical device by said digital control signal.

The method further including the steps of forming the first and shortest form of the search argument and the stored search-argument part on the basis of the last code in the code sequence;

forming the possible next-higher forms of the search argument and the stored search-argument part on the basis of two or more last codes;

forming all the highest-level forms of the search argument and the stored search-argument part by gradually appending symbols with more general meaning to the left side of the search argument and the stored search-argument part;

forming the more general symbols by studying groups of preceding codes in the code sequence;

identifying these groups with the most similar members of a finite set of predetermined reference groups; and representing the corresponding reference groups by predetermined high-level symbols.

The method further including the step of:

determining each more general symbol by studying the set of notes occurring in a time interval, exactly or approximately complying with the set of notes in a standard chord.

Additionally, the method including the steps of:

generating at least one additional code sequence, such as a note code sequence representing a voice accompanying a melody, by having in the consequence-part of the rules at least one extra notes, fractions of notes, or groups of notes, which make up the additional voices but are not necessarily involved in considering the conflicts.

Also, the method including the steps of:

continuing if a search argument equivalent to a stored search argument is not found in the search table when generating a code sequence and the search argument is still shorter than a specified minimum length, a limited, random number of codes preceding this situation is extracted from the code sequence and the generation of the code sequence on the basis of the remaining codes and new random choices.

Additionally, the method of controlling an electronic musical device, comprises steps of:

providing a training sequence of codes, on the basis of which the search table is constructed automatically, each code in the training sequence representing a note, a fraction of a note, or a group of notes, establishing the search table as a list of rules, each rule consisting of a stored search-argument part, a consequence part, and a conflict-information bit, by scanning several times the training sequence from left to right, code by code, and at each scanning step forming a tentative ordered set of search arguments;

ranking said search arguments on successively higher levels according to the number of codes used in them, with the lowest-level search argument consisting of the scanned code, and the higher-level search arguments being formed of two or more codes including and preceding the scanned code in the training sequence;

at each scanning step possibly adding new rules to the table based on at least one of the following steps starting with the lowest-level search argument and searching for it in the table;

if the search argument is not found, storing the rule consisting of the lowest-level search argument, the code following the scanned code in the training sequence, and the conflict bit, which now has the value 0, into the table;

if the search argument already exists in the table, if the conflict bit is 0, and the consequence part of the stored rule is different from the code following the scanned code in the training sequence, setting the conflict bit to value 1 and storing a new rule, consisting of the next-higher tentative search argument, the code following the scanned code in the training sequence, and a conflict bit with value 0 into the table;

if the search argument already exists in the table, but the conflict bit is 1, taking the next-higher tentative search argument and searching for it in the table, and if the conflict bit in this rule is still 1, continuing searches with progressively higher search arguments, until eventually on a level not exceeding the highest allowable level, the search is still successful and a conflict bit 0 is found, and the respective stored consequence part is different from the code following the scanned code in the training sequence, or the searching sequence terminated on some level as unsuccessful, in which cases a rule consisting of the last search argument, the code following the scanned code in the training sequence, and a conflict bit with value 0 is stored into the table;

generating a digital code sequence, each code in this sequence representing a musical element such as a predetermined note, fraction of a note, or group of notes, whereby new codes are generated one at a time on the basis of the last codes in the earlier generated sequence and information searched from the table, and appended to the earlier generated sequence, the generation of each new code including at least the steps of forming a tentative ordered set of search arguments to be used in a sequential search, said search arguments being ranked on successive higher levels according to the number of codes used in them, with the lowest-level search argument consisting of the last code and the higher-level search arguments being formed of two or more last codes taken from the earlier generated code sequence;

starting with the lowest-level search argument, performing a sequential search in the table and continuing with gradually higher-level search arguments, until a conflict-free rule or the highest predetermined level is reached, or the sequential search that started as successful finally is terminated as unsuccessful;

randomly selecting the consequential code to be appended to the earlier generated code sequence from a specified subset of rules encountered in said sequential search;

converting said generated code sequence into a digital control signal; and automatically controlling the electronic musical device by said digital control signal.

The method of the invention utilizes the principle of dynamically expanding context in the production of a continuous sequence of codes. This principle has previously been applied in speech recognition (see [1] Dynamically expanding context, with application to the correction of symbol strings in the recognition of continuous speech, Teuvo Kohonen, Proceedings of the Eighth International Conference on Pattern Recognition, Oct. 27–31, 1986, Paris, France (IEEE Computer Society) p. 1148–1151. The present method differs from speech recognition mainly in that in the last-mentioned the method is used primarily for correcting codes whereas the present method creates continuously new stochastic sequence of codes.

Similarly as in Markov processes, a code in a sequence of codes is defined in the present method on the basis of codes immediately preceding it. The present invention, however, uses discrete "grammatical" rules in which the length of the contents of the search arguments of the rules, that is, the number of required preceding codes, is a dynamic parameter which is defined on the basis of discrepancies (conflicts) occurring in the training sequence (strings) when the rules are being formed from the training sequences. In other words, if two or more rules have the same search argument but different consequences, that is, a new code, during the production of the rules, these rules are indicated to be invalid, and the length of their search argument is increased until unambiguous or valid rules are found. However, all such shorter, mutually conflicting invalid rules are also maintained and formed into a tree structure as described. The method of dynamically expanding context is to a very great extent based on the utilization of this structure. As the mentioned rules are produced mechanically on the basis of local equivalences between symbols occurring in the training material, the production of rules does not, for instance, require music theoretical analysis based on expertise on the training music material.

Correspondingly, when the rules are utilized to generate a new code after a sequence of codes, the code generated last in the code sequence is first compared with the rules in a search table stored in the memory, then the two last codes are compared, etc., until an equivalence is found with the search argument of a valid rule, whereby the code indicated by the consequence of this rule can be added last in the sequence of codes. The above-mentioned tree structure enables systematic comparisons. This results in an "optimal" sequence of codes which "stylistically" attempts to follow the rules produced on the basis of the training sequences. When the method is applied as such to produce a sequence of note codes, the produced music is in the desired style but may still contain rather long copied portions of the training material.

Variety and surprising changes can be produced in the sequence of codes by using random choice at least intermittently. In other words, after a valid rule has been found, it is replaced randomly with an invalid rule associated with it and having the same search argument as the found rule deceased with a random number of codes.

A code produced automatically in a computer by the method of the invention is a control signal used for the control of electronic musical instruments or synthesizers either directly or converted into suitable control signals complying with the MIDI standard, for instance. As can be appreciated, the term "electronic musical instrument" is intended to include all electronic means which produce synthesized music.

BRIEF DESCRIPTION OF THE DRAWINGS

The invention will now be described in greater detail with reference to the attached drawings, in which FIG. 1 illustrates a code structure applicable in the method of the present invention;

FIG. 2 shows a search table to be used in the method of the invention;

FIG. 3 illustrates a tree structure formed by interconnected rule propositions;

DESCRIPTION OF THE INVENTION

Figure 4:
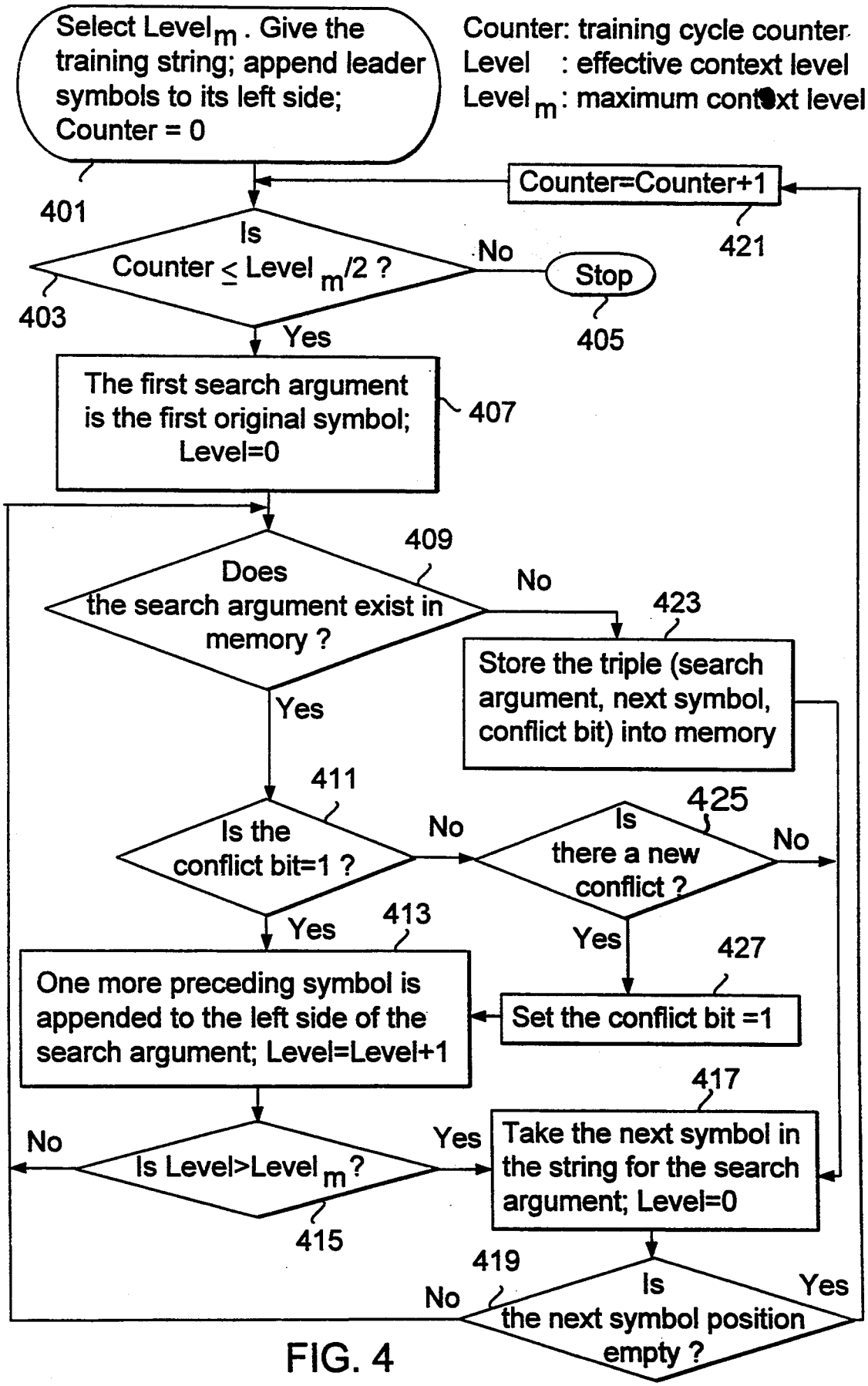
FIG. 4 shows a flow diagram for an automatic generation of a search table according to the present invention.

In the method of the invention, individual code types represent a musical element such as a predetermined note, fraction of a note, or group of notes. Alternatively, the codes may represent other quantities which can be represented by quantized states. In a preferred embodiment, a note is described by two or more quantized properties of a tone, such as tone pitch and duration. FIG. 1 illustrates one preferred 16-bit code structure in which the seven least significant bits represent tone pitch k which may thus have 128 different values or which one may indicate a rest. The seven following bits represent tone duration p which may also have 128 different values. Finally, the two most significant bits represent the beat phase of the notes, that is, the position of the note in a time or time section. In the four-four music used in the present example, it may thus have four different states.

FIG. 2 illustrates the structure of the search table to be used in the method of the invention, which search table is stored in the memory of the computer. The search table consists of rules each one of which comprises premises (search arguments) X, a consequence (next code) Y and a conflict bit Z. The state 0 of the bit Z indicates a valid proposition (no conflicts), and the state I indicates an invalid proposition (conflict).

The principles of the production of rules for the search table of the invention are discussed generally in the above-mentioned article [1]. The invention applies a specific case of the procedure described in the article, in which only the preceding codes on the left side of the code to be treated are taken into account when producing rule propositions.

The procedure can be illustrated by a simple example. Assume that a training string sequence in which letters represent code types, reads:

ABCDEFG . . . TKFH . . . LEFJ . . .

If one now attempts to determine the next code solely on the basis of, for instance, the code F (which occurs several times in the training string), a threefold conflict or discrepancy will occur. The code F could be followed by any of the codes G, H or J. If the symbol preceding the code F is included in the contents of the search argument in an attempt to increase the precision of the code patterns, there still exists a twofold conflict: the combination EF could be followed by G or J. The combination KF, however, already forms a valid rule at its point, giving as an outcome the unambiguous code H. In cases where F is preceded by E, two symbols preceding F can be included in the search arguments, whereby all conflicts can be solved. For these points, two valid rules can be formed. In one of the rules the search argument is DEF and the consequence (the next code) is G while in the other the search argument is LEF and the consequence (the next code) is J.

Invalid rules produced during the production of rules are not, however, deleted because they are needed both in the construction of the rule tree to be described below and in the production of new codes in the sequence of codes. Instead, each produced rule is indicated to be valid or invalid by the above-mentioned conflict bit Z. Rules are similarly searched separately for each code in the training string or sequence. In this way a search table is formed which contains valid and invalid rules with search arguments of varying length.

The information structure of the rules stored in the search table is illustrated in FIG. 3 by a graphical representation interconnecting the rules. For each predetermined code (such as F) there is a tree the root of which is formed by a rule with search argument containing this particular code only. If the training strings contain conflicts, at least two branches extend from the root. The branches lead to nodes in which the search of the rule contain some other code in addition to the code F. The consequences of the branches are written beside the branches. The last nodes of the tree, representing leaves, correspond to the final valid rules, whereas all the other nodes correspond to invalid rules.

A flow diagram for automatic generation of a search table of the inventive method is shown in FIG. 4.

With reference to FIG. 4, step 401 selects the LEVEL. The LEVEL is defined as an effective context level. The training string is given and the leader symbols are appended to the left side. Also, the COUNTER is set to zero.

At decision step 403, the COUNTER is compared to LEVEL m. If COUNTER is greater than LEVEL m, the system stops at 405. If COUNTER is equal to or less than LEVEL m, the system moves on to block 407.

At block 407, the first search argument becomes the first original symbol and LEVEL is set to zero. The system then moves to decision block 409. At this point, a check is made to determine if the current search argument exist in memory. If the current search argument does exist in memory, another comparison is made. At decision block 411, the conflict bit is checked. If the conflict bit equals one, the system moves to block 413. At this block, one or more preceding symbol is appended to the left side of the search argument. Also, LEVEL is increment to LEVEL +1. Now, at decision block 415 a check is made to compare LEVEL and LEVEL m. If LEVEL is less than LEVEL m, the system moves back to decision block 409. If LEVEL is greater than LEVEL m, the system proceeds to block 417. At block 417, the system selects the next symbol in the string for the search argument. Also, LEVEL is set to zero. The system then moves to a further decision block. At 419, a check is made to determine whether the next symbol position is empty. If the next symbol position is not empty, the system returns to decision block 409. If the next symbol position is empty, the system increments COUNTER to COUNTER plus one at block 421 and proceeds to decision box 403 wherein the flow continues as previously explained.

Now, returning to the decision box 409 wherein the flow was described, and a check for the search argument in memory indicated that the search argument existed in memory, an alternative flow is discussed. If the search argument is not found in memory, the system proceeds to box 423. At 423, the system stores the search argument, next symbol and the conflict bit into memory. This is given the name TRIPLE. Accordingly, the TRIPLE exists in memory. The system, with the TRIPLE in memory, proceeds to box 417 and the system continues as previously explained.

At decision block 411, a check is made to determine whether the conflict bit equals one. If the conflict bit does not equal one, the system moves to decision block 425. At 425, the system checks if there is a new conflict. If there is no new conflict, the system continues to box 417. If there is a new conflict, the system enters box 427 and sets the conflict bit equal to one. After this procedure is accomplished, the system goes to box 413 and carries on in the operation.

The following discussion deals with the automatic generation of a new symbol to a code sequence so as to provide a control signal for electronic musical instruments. Assume that the initial sequence (the seed string) is CDEF. A key sequence (a search argument) growing by degrees and produced on the basis of one or more codes produced last in the seed string is utilized in the search of a new code. Initially the key sequence is always formed by the last code of the initial sequence, in this particular case by F. When the key sequence is now compared with the search table of FIG. 2, it is found that a rule with this kind of search argument has the state 1 of the conflict bit, so it is invalid. Thereafter the code E preceding the last code F in the seed string is added to the beginning of the key sequence, so that the key sequence now has the length of two codes, being EF. When comparing with the search table of FIG. 2, it is to be seen that this search too leads to an invalid rule. The third last code D in the seed string is then added to the key sequence, whereby the key sequence becomes DEF. The search performed by this key sequence gives the valid rule in the memory position 13, and the code G indicated by the consequence of this rule is added as a next code to the end of the initial sequence. This increased code sequence is now used as a new seed string, whereby the first key sequence in the generation of a new code contains the code G. The length of the key sequence is again increased until a valid rule is found.

The above-described basic method easily results in a code sequence which forms copies of training material portions and may even start to repeat itself.

For this reason, the code indicated by the found valid rule is not always selected as the new code in the embodiment of the invention. Instead, a kind of random choice is used in which the extent of the changes are adjustable. The generation of such new, partially random sequences can be illustrated by means of the preceding example and FIG. 3. Assume again that the seed string is CDEF, and a valid rule is searched in accordance with the above example. The search thereby begins from the root F of FIG. 3 and follows the branches until an equivalent leaf, in this particular case DEF, is found. In the example, the code G indicated by the found leaf DEF was selected as a new code. On the path from the root to the leaf, however, there are possibly several nodes which contain invalid rules giving various alternative new codes. In the present method the last key sequence, by which the valid rule was found, is shortened at random at the most by a predetermined number of codes, and one of the invalid rules having search arguments equivalent to the shortened key sequence is selected as a new code. In other words, at the most a limited number of steps are taken at random to return from the leaf of the rule tree. In this way, random variation is produced in the obtained code sequence. In the case of a note sequence, which is applied to an electronic musical instruments as a control signal, synthesized music is produced with variety and surprising changes while the music still conforms to certain rules.

Figure 5:
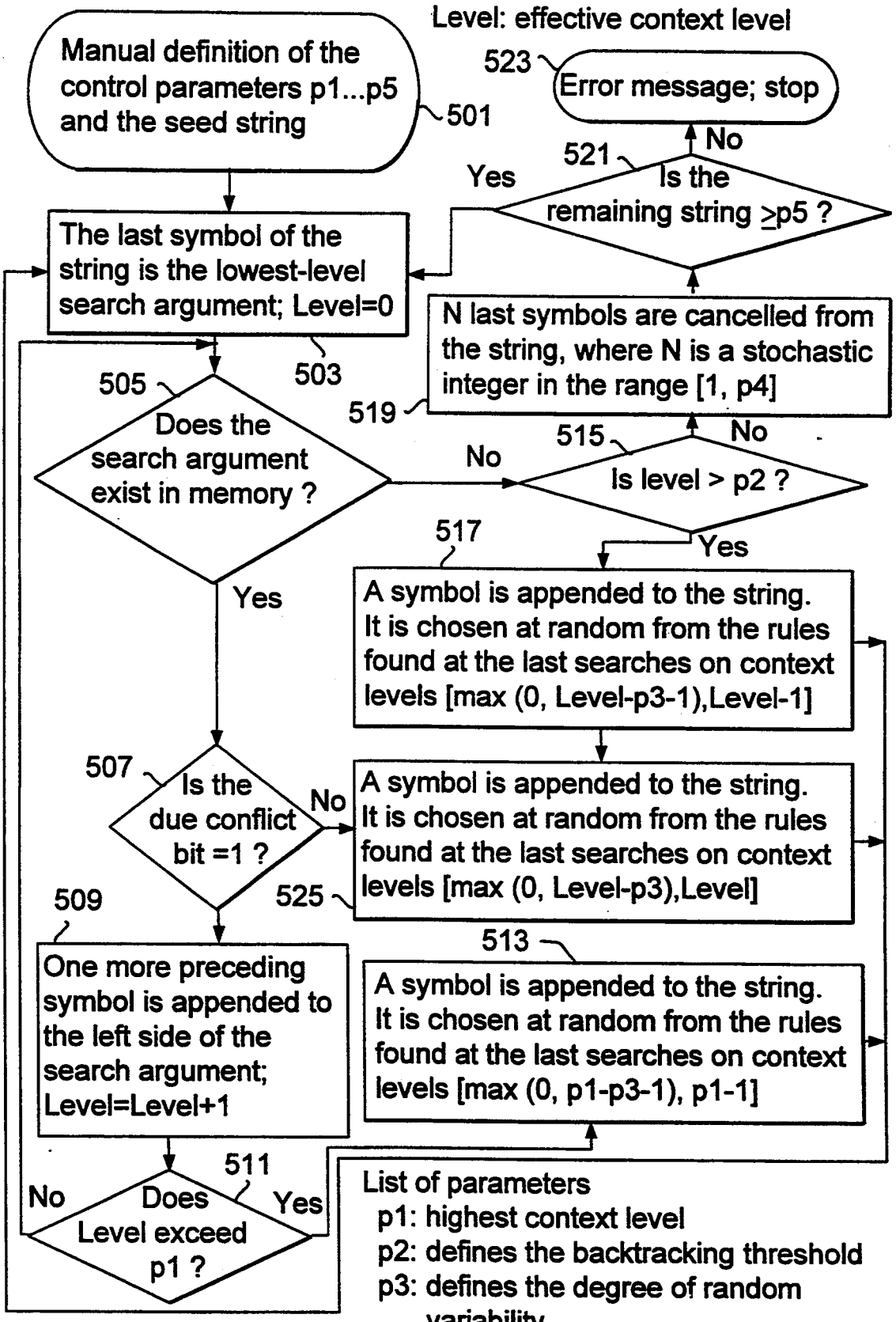
FIG. 5 shows a flow diagram for an automatic code sequence generation according to the invention.

A flow diagram for automatic code sequence generation according to the invention is shown in FIG. 5.

With reference to FIG. 5, in step 501 the manual definitions of the control parameters and seed string are entered into the system. The parameters are defined as follows:

P1: defines the highest context level
P2: defines the backtracking threshold
P3: defines the degree of random variability
P4: defines the longest backtracking
P5: defines the smallest allowable string length After receiving the parameters, the system begins the automatic code sequence operation. Block 503 takes the last symbol of the string and defines it as the lowest-level search argument with LEVEL equal to zero. Decision block 505 is entered and the system checks to determine whether the search argument exist in memory. If the search argument does exist in memory, the system moves to decision block 507. At 507, the determination is made based on the due conflict bit. If the due conflict bit equals one, the system continues to box 509. At box 509, one or more preceding symbol is appended to the left side of the search argument. Additionally, LEVEL is incremented to LEVEL plus one. The system tests LEVEL by comparing LEVEL to P1 in decision block 511. If LEVEL does not exceed P1, the system returns to decision block 505. If LEVEL exceeds P1, the system moves to box 513. At box 513 a symbol is appended to the string. The symbol is chosen at random from the rules found during the last searches on context levels. In box 513, the context levels are still at a maximum [(O, P1-P3-1), P1-1]. Now, the system returns to box 503 and continues the flow.

At box 505, if the search argument does not exist in memory, the system moves to decision box 515. Here, at box 515, a check of LEVEL is made. If LEVEL is greater than P2, the system moves to box 517. In box 517, a symbol is appended to the string. The symbol is chosen at random from the rules formed at the last searches on context levels. Once again, the context levels are set for a maximum at [(O, LEVEL-P3-1), LEVEL]. The system then returns to box 503. If LEVEL is less than P2, the system enters box 519. At box 519, N last symbols are cancelled from the string. N is a stochastic integer in the range of [1, P4]. After box 519, the system enters another decision. At box 521, a check of the remaining string is made. If the remaining string is equal to or greater than P5, the system moves back to 503. If the remaining string is less than P5, the system stops and enters an error message as indicated by 523.

Returning to decision block 507, a "no" to the question—is the conflict bit equal to one?—moves the system to block 525. At 525, a symbol is appended to the string. The symbol is chosen at random from the rules formed at the last searches on context levels with the maximum being [(O, LEVEL-P3), LEVEL]. After box 525 is completed, the system returns to box 503, and the flow is continued.

As mentioned, both the key sequence and the search arguments of the rules are formed solely by basic codes. Even though the music obtained by using this kind of method for producing note code sequences gives a feeling of musical continuity, typical Western music favors melodic arrangements of a still greater harmony.

This object is achieved, e.g., by another embodiment of the invention, in which, e.g., only the two last symbols in the key sequence and in the search arguments of the rule consist of absolute codes while the preceding symbols stand for information of higher level, each representing a different combination formed by a group of at least two codes. In musical terms, the higher-level symbols may represent, e.g., chords which best describe the melody sequences and which are formed by the notes of preceding times, half times, quadruple times, etc., and in which the order of the notes of the combination may be arbitrary. In place of musical chords, it is also possible to use other clusters of note combinations (histograms) occurring in the example material. In this particular embodiment the search argument of the rule are formed, e.g., by the last two note codes, as previously described. The example sequence preceding them is, however, analyzed in groups of two or more codes which are compared with a preformed library of higher-level symbols. When one of the code combinations is recognized as a certain symbol, this symbol is included in the search argument of the rule on the left side of the first two codes. In the same way, more higher-level symbols can be added to the left end of the search argument. The rule may thus contain one or more such higher-level symbols or none. As a melody may contain notes which do not belong to the chord or to the histograms corresponding to the clusters, the recognition of the symbols in a short code sequence has to be based on approximation pattern recognition techniques.

A new code sequence is produced on the basis of these rules in such a way that the two shortest forms of key sequences are, for instance, formed as described above, and the following forms of the key sequences are formed by recognizing combinations formed by groups of two or more preceding codes in the seed string and by replacing them with higher-level symbols equivalent to them or to combinations closest to them.

This embodiment may also utilize the above-mentioned random choice.

When polyphonic music is produced by the method described above, the first note code sequence, corresponding to the main tone or melody, is formed first on the above-mentioned way utilizing a first search table. The first note code sequence is then used as a seed string, and one or more additional code sequences, each corresponding to one accompanying tone, are formed by means of one or more additional search tables, respectively. The additional tables contain separate rules for each accompanying tune.

The method of the invention is intended particularly for the production of note code information in digital form for the control of electronic musical instruments or synthesizers or other such devices. The produced note codes can be converted into control signals complying with the MIDI standard, and these signals are further applied to the above-mentioned devices. The abbreviation MIDI stands for Musical Instrument Digital Interface and is a standard interface through which synthesizers, rhythm machines, computers, etc., can be linked together. Information on MIDI standards can be found, e.g., from [2] MIDI 1.0 specification, Document No. MIDI-1.0, August 1983, International MIDI Association.

Figure 6:
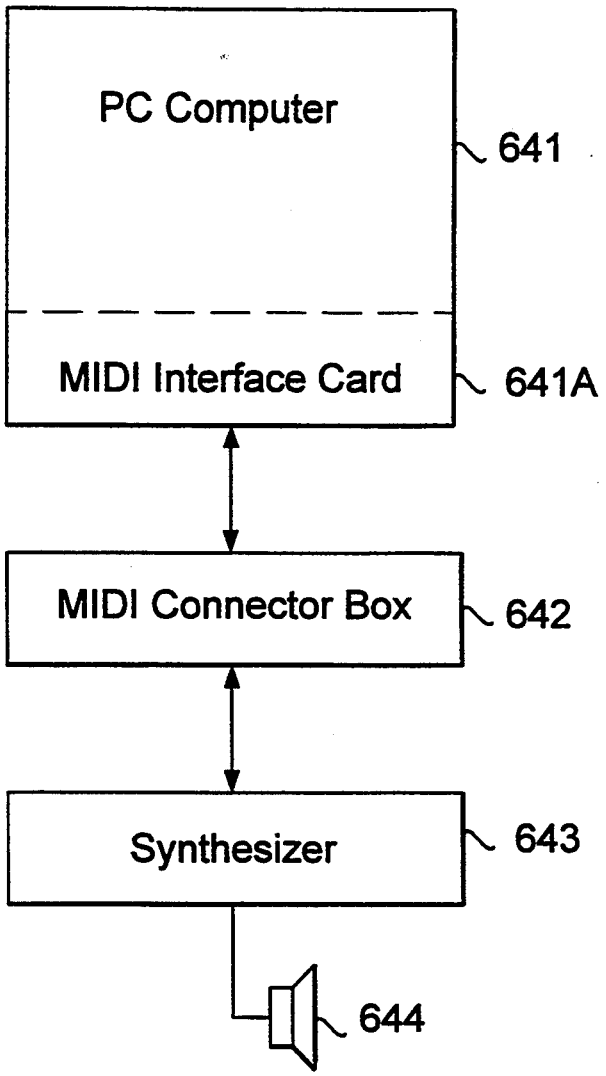
FIG. 6 shows a block diagram of electronic equipment in which the invention may be embodied.

FIG. 6 illustrates one example of electronic equipment in which the invention may be embodied. A personal computer (PC) 641, e.g. Toshiba T6400 DXC, is provided with a MIDI interface card 641A, e.g. CPU Card of the MIDI Processing Unit Roland MPU-IPC-T. MIDI interface card 641A is further connected by a MIDI computer box 642, e.g. connector box of MIDI Processing Unit Roland MPU-IPC-T, to an electronic musical instrument 643, e.g. Yamaha DX-7 synthesizer. A loudspeaker 644 is connected to the synthesizer 643. PC 641 is also provided with a suitable software program which forms the rules from a source code and generates the digital code as described above and according to the generated digital code controls the synthesizer 643 through the MIDI interface 641A, 642. The digital code may be generated for example by the software shown in Appendix 2. By the software shown in Appendix 3 the generated digital code an be utilized for controlling ("playing") the synthesizer 643. The programming language C is used in the software. One example of the source code used by the software of the Appendix 2 is shown in Appendix 1. The Appendix 1 contains also description of the eight decimal integers utilized for representing notes in the source code. Also the key sequence used in the beginning of the generation and the resulting generated code are in the same format.

The figures and the description related to them are only intended to illustrate the present invention. In its details, the method of the invention may vary within the scope of the attached claims.

I claim:

1. A method of controlling an electronic musical device, comprising the steps of:

accessing, on a basis of a search-argument, a search table containing rules for the generation of sequences of control codes, each rule consisting of a search-argument part of variable length, a possible consequence to the search argument, and additional information about possible conflicts of this rule with other rules, wherein said rules being ranked on successively higher levels according to the length of their search-argument part;

generating a digital code sequence, each code in this sequence representing a musical element such as a predetermined note, fraction of a note, or group of notes, whereby new codes are generated one at a time on the basis of the last codes in an earlier generated sequence and information searched from the table, and appended to said earlier generated sequence, the generation of each new code including at least the step of forming a tentative ordered set of search arguments to be used in a sequential search;

ranking said search argument on successively higher levels according to the number of codes used in them, with a lowest-level search argument consisting of the last code and higher-level search arguments being formed of two or more last codes taken from the earlier generated code sequence;

starting with the lowest-level search argument, performing a sequential search in the table and continuing with gradually higher-level search arguments and until a rule having no conflicts with either rules is found, or the sequential search finally is terminated as unsuccessful when a predetermined search argument level is reached;

randomly selecting a consequential code to be appended to the earlier generated code sequence from a specified subset of rules encountered in said sequential search;

converting said generated code sequence into a digital control signal; and automatically controlling the electronic musical device by said digital control signal.

2. A method according to claim 1, further including the steps of:

forming the first and shortest form of the search argument and the stored search-argument part on the basis of the last code in said digital sequence;

forming the possible next-higher forms of the search argument and the stored search-argument part on the basis of said two or more last codes;

forming all the highest-level forms of the search argument and the stored search-argument part by gradually appending higher-level symbols to the search argument and the stored search-argument part, said each higher-level symbol representing a predetermined group of codes such as preceding times, half times, quadruple times and other times;

forming the higher-level symbols by studying groups of preceding codes in the code sequence;

identifying these groups with the most similar members of a finite set of predetermined reference groups; and representing the corresponding reference groups by predetermined higher-level symbols.

3. A method according to claim 2, including the step of:

determining each more general symbol by studying the set of notes occurring in a time interval, complying with the set of notes in a standard chord.

4. A method according to claim 1, including the step of:

generating at least one additional code sequence, such as a note code sequence representing a voice accompanying a melody, by having in the consequence-part of the rules extra notes, fractions of notes, or groups of notes, which make up the additional voices but are not involved in considering the conflicts with the rules.

5. A method according to claim 1, including the step of:

if search argument equivalent to a stored search argument is not found in the search table when generating a code sequence and the search argument is still shorter than a specified minimum length, a limited random number of codes preceding this situation is extracted from the code sequence and the generation of the code sequence is continued on the basis of the remaining codes and new random choices.

6. A method of controlling an electronic musical device, comprising the steps of:

providing a training sequence of codes, on the basis of which a search table is constructed automatically, each code in the training sequence representing a note, a fraction of a note, or a group of notes, establishing the search table as a list of rules, each rule consisting of a stored search-argument part, a consequence part, and a conflict-information bit, by scanning several times the training sequence from left to right, code by code, and at each scanning step forming a tentative ordered set of search arguments;

ranking said search arguments on successively higher levels according to the number of codes used in said search in arguments, with the lowest-level search argument consisting of the scanned code, and the higher-level search arguments being formed of two or more codes including and preceding the scanned code in the training sequence;

at each scanning step possibly adding new rules to the table based on at least one of the following steps starting with the lowest-level search argument and searching for it in the table;

if the search argument is not found, storing the rule consisting of the lowest-level search argument, the code following the scanned code in the training sequence, and the conflict bit, which now has the value 0, into the table;

if the search argument already exists in the table, if the conflict bit is 0, and the consequence part of the stored rule is different from the code following the scanned code in the training sequence, setting the conflict bit to value 1 and storing a new rule, consisting of the next-higher tentative search argument, the code following the scanned code in the training sequence, and a conflict bit with value 0 into the table;

if the search argument already exists in the table, but the conflict bit is 1, taking the next-higher tentative search argument and searching for it in the table, and if the conflict bit in this rule is still 1, continuing searches with progressively higher level search arguments, until eventually on a search argument level not exceeding a highest allowable search argument level, the search is still successful and a conflict bit 0 is found, and the respective stored consequence part is different from the code following the scanned code in the training sequence;

if the searching sequence terminated on any level as unsuccessful, a rule consisting of the last search argument, the code following the scanned code in the training sequence, and a conflict bit with value 0 is stored into the table;

generating a digital code sequence, each code in this sequence representing a musical element such as a predetermined note, fraction of a note, or group of notes, whereby new codes are generated one at a time on the basis of the last codes in an earlier generated sequence and information searched from the table, and appended to the earlier generated sequence, the generation of each new code including at least the steps of forming a tentative ordered set of search arguments to be used in a sequential search;

ranking said search arguments on successive higher levels according to the number of codes used in them, with the lowest-level search argument consisting of the last code and the higher-level search arguments being formed of two or more last codes taken from the earlier generated code sequence;

starting with the lowest-level search argument, performing a sequential search in the table and continuing with gradually higher-level search arguments, until a rule in which the conflict bit is zero is found, or the sequential search finally is terminated as unsuccessful when a predetermined search argument level is reached;

randomly selecting a consequential code to be appended to the so far generated code sequence from a subset of rules encountered in said sequential search;

converting said generated code sequence into a digital control signal; and automatically controlling the electronic musical device by said digital control signal.

* * * * *